US006486843B2

(12) United States Patent
Wang et al.

(10) Patent No.: US 6,486,843 B2
(45) Date of Patent: Nov. 26, 2002

(54) ON-VEHICLE ROD ANTENNA DEVICE

(75) Inventors: Jinsong Wang, Kawasaki; Junichi Kawahata, Yokosuka, both of (JP)

(73) Assignee: Harada Industry Co., Ltd., Tokyo (JP)

( * ) Notice: Subject to any disclaimer, the term of this patent is extended or adjusted under 35 U.S.C. 154(b) by 0 days.

(21) Appl. No.: 09/931,424

(22) Filed: Aug. 16, 2001

(65) Prior Publication Data

US 2002/0021254 A1 Feb. 21, 2002

(30) Foreign Application Priority Data

Aug. 21, 2000 (JP) ..... 2000-249676

(51) Int. Cl.[7] ..... H01Q 1/32; H01Q 9/30
(52) U.S. Cl. ..... 343/715; 343/900; 343/906
(58) Field of Search ..... 343/715, 713, 343/711, 900, 901, 903, 906, 880, 882, 888, 702

(56) References Cited

U.S. PATENT DOCUMENTS

| | | | | | |
|---|---|---|---|---|---|
| 4,047,779 | A | | 9/1977 | Klancnik | 339/9 |
| 4,243,989 | A | * | 1/1981 | Piper | 343/715 |
| 5,616,043 | A | | 4/1997 | Liou | 343/715 |
| 5,661,497 | A | * | 8/1997 | Calearo | 343/715 |
| 5,949,386 | A | * | 9/1999 | Elliott | 343/906 |
| 5,950,116 | A | | 9/1999 | Baro | 455/90 |
| 6,100,852 | A | * | 8/2000 | Calearo | 343/715 |

FOREIGN PATENT DOCUMENTS

| | | | | |
|---|---|---|---|---|
| EP | 0 443 172 | A1 | 8/1991 | H01Q/1/03 |
| EP | 0 800 226 | A1 | 10/1997 | H01Q/1/08 |
| JP | 08 335821 | A | 3/1999 | H01Q/1/32 |
| JP | 11274832 | A | 10/1999 | H01Q/1/32 |
| WO | WO 99 13530 | A | 3/1999 | H01Q/1/32 |
| WO | WO 99 48167 | A | 9/1999 | H01Q/1/32 |

OTHER PUBLICATIONS

European Search Report for app. no. EP 01 30 7089, with cover letter from EPO dated Jul. 10, 2002.

* cited by examiner

*Primary Examiner*—Tan Ho
*Assistant Examiner*—Hoang Nguyen
(74) *Attorney, Agent, or Firm*—Pennie & Edmonds LLP

(57) ABSTRACT

An on-vehicle rod antenna device comprises an antenna rod, and an antenna base comprising a joint section to which the antenna rod is connected, in which the joint section comprises a tip portion, the tip portion is covered with the antenna rod in a state of connecting the antenna rod, and a substantially hemisphere recess or salient engaging with an inner circumferential surface of the antenna rod is formed on an outer circumferential surface of the tip portion.

8 Claims, 3 Drawing Sheets

ON-VEHICLE ROD ANTENNA DEVICE

CROSS-REFERENCE TO RELATED APPLICATIONS

This application is based upon and claims the benefit of priority from the prior Japanese Patent Application No. 2000-249676, filed Aug. 21, 2000, the entire contents of which are incorporated herein by reference.

BACKGROUND OF THE INVENTION

1. Field of the Invention

The present invention relates to an on-vehicle rod antenna device.

2. Description of the Related Art

FIG. 1A is a figure which shows an external configuration of the conventional on-vehicle rod antenna device. The rod antenna device 10 is constructed such that the antenna rod 13 is screwed and attached to the joint assembly 12 rotatably provided on the antenna base 11 mounted on the vehicle as shown in FIG. 1A.

FIG. 1B is a figure which shows an external configuration of the joint assembly 12, especially, in a state of detaching the antenna rod 13. In FIG. 1B, the antenna rod cover 13*a* forms the outer surface of the above-mentioned antenna rod 13.

A tip portion of the joint assembly 12 is covered with the antenna rod cover 13*a* by attaching the antenna rod 13. The plurality of hexahedron-shaped the projections 12*b* (for example, at 4 portions) made of the resin with the ABS resin etc. is radially formed, along outer circumferential surface of the metal cylindrical body 12*a* screwed at inner circumferential surface on an tip portion of the joint assembly 12. FIG. 1C shows an outline view of the joint assembly 12.

A size of the outside diameter at the end surface position of the outer circumferential surface of each the projections 12*b* is set slightly larger than a size of the inside diameter of this contact portion of the antenna rod cover 13*a* with the corresponding elasticity. When screwing and attaching the antenna rod 13 to mount it on the joint assembly 12, the inner surface of the antenna rod cover 13*a* is pushed by the projections 12*b* and transformed with elasticity. Thereby, the antenna rod 13 is prevented from loosening and departing from the joint assembly 12 by the outside power such as the vibrations.

That is, the projections 12*b* of the joint assembly 12 are formed as a stopper of the antenna rod 13 loosening to the vibration, etc. of the vehicle where the on-vehicle rod antenna device 10 is attached.

In the antenna rod 13 attached on the joint assembly 12, the installation metal fittings (not shown in the figure) with a tip portion which screws to the above-mentioned cylindrical body 12*a* in cylindrical bottom of the antenna rod cover 13*a* are laid underground. Then, the antenna rod element (not shown in the figure) is drawn out and undergrounded to the axis portion of the antenna rod cover 13*a* so as to be connected with this installation metal fittings.

The outside diameter at the outer circumferential surface position of the projections 12*b* of the joint assembly 12 is set larger than the inside diameter at the position where the antenna rod cover 13*a* of the corresponding antenna rod 13 corresponds as mentioned above. By screwing the installation metal fittings of the antenna rod 13 to the cylindrical body 12*a* of the joint assembly 12, when the antenna rod 13 is connected with the joint assembly 12, The projections 12*b* transform the antenna rod 13 by the elasticity of the antenna rod cover 13*a* and the frictional force corresponding to the elasticity power is given to the inner surface of the antenna rod cover 13*a*. As a result, the antenna rod 13 is prevented from loosening from the joint assembly 12 by the vibration of the vehicle etc.

Therefore, since the locking effect of the projections 12*b* of the joint assembly 12 changes greatly according to largeness of elasticity of antenna rod cover 13, largeness of friction with inside of the antenna rod cover 13, the outside diameter at the outer circumferential surface position and a size of the antenna rod cover 13*a* inside diameter. A very small allowance is required at the manufacturing, there is a disadvantage of raising the manufacturing cost as a result.

In addition, when the outer circumferential surface of the projections 12*b* wear out by repeating the attaching/detaching of the antenna rod 13 to the joint assembly 12, an initial locking effect is lost at once.

In EC safety standard (European safety standard), so that the projection object mounted on the car may never give the person harm, even the state of detaching the antenna rod 13, it is a reference that all positions where the human body may be contacted to the joint assembly 12 have the roundness of R 2.5 mm or more (5 mm or more in the diameter) and the small R and the corner of less than R 2.5 mm are prohibited.

However, the cylindrical body 12*a* and the projections 12*b* of the joint assembly 12 and the neighborhood thereof have small R and the corner of less than R 2.5 mm as seen from FIG. 1C. Therefore, it is not possible to agree with the above-mentioned EC safety standard.

BRIEF SUMMARY OF THE INVENTION

An object of the present invention is to provide an on-board rod antenna device in which a sufficient locking effect can be maintained for a long period without requiring a sever size accuracy in manufacturing, and a pointed component is not exposed to an outside, where the human body may be contacted, even in a state of detaching the antenna rod.

An on-vehicle rod antenna device according to the present invention is characterized by comprising: an antenna rod; and an antenna base comprising a joint section to which the antenna rod is connected, in which the joint section comprises a tip portion, the tip portion is covered with the antenna rod in a state of connecting the antenna rod, and a substantially hemisphere recess or salient engaging with an inner circumferential surface of the antenna rod is formed on an outer circumferential surface of the tip portion.

DETAILED DESCRIPTION OF THE INVENTION

Figure 1C:
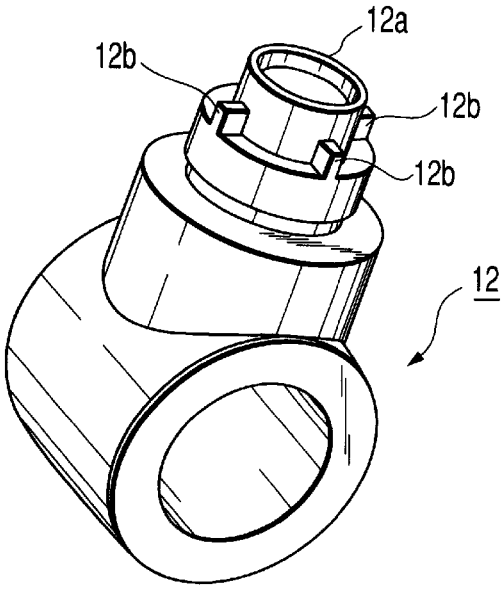
FIG. 1C PRIOR ART
FIG. 1A to FIG. 1C are figures which show the external configuration etc. of the conventional on-vehicle rod antenna device.
Figure 1A:
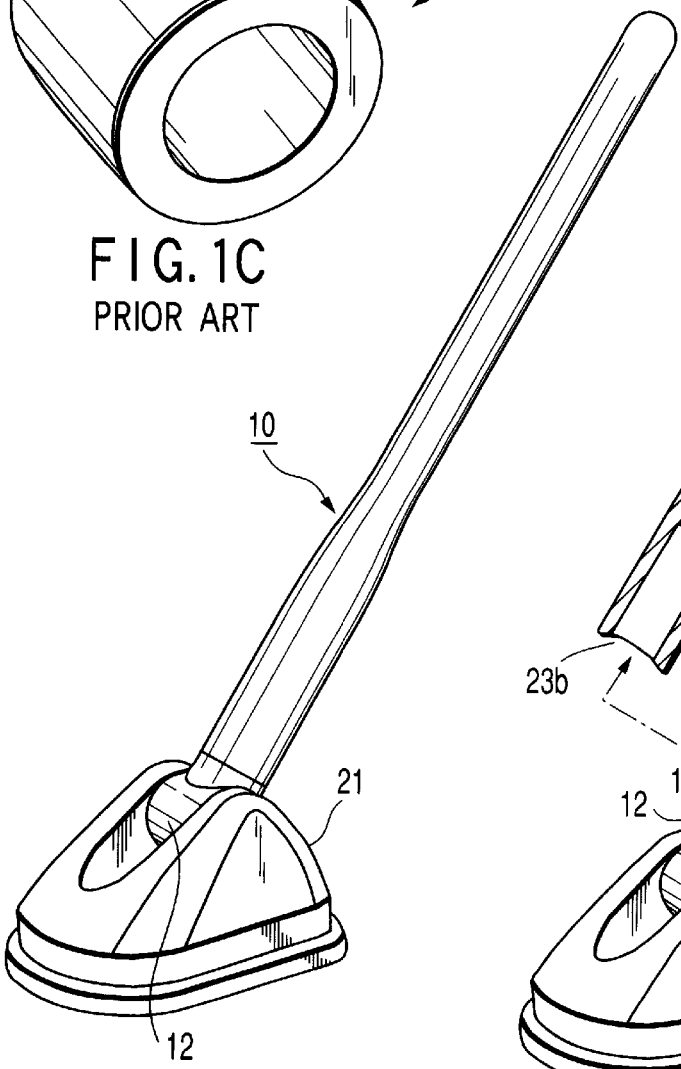
FIG. 1A PRIOR ART
Figure 1B:
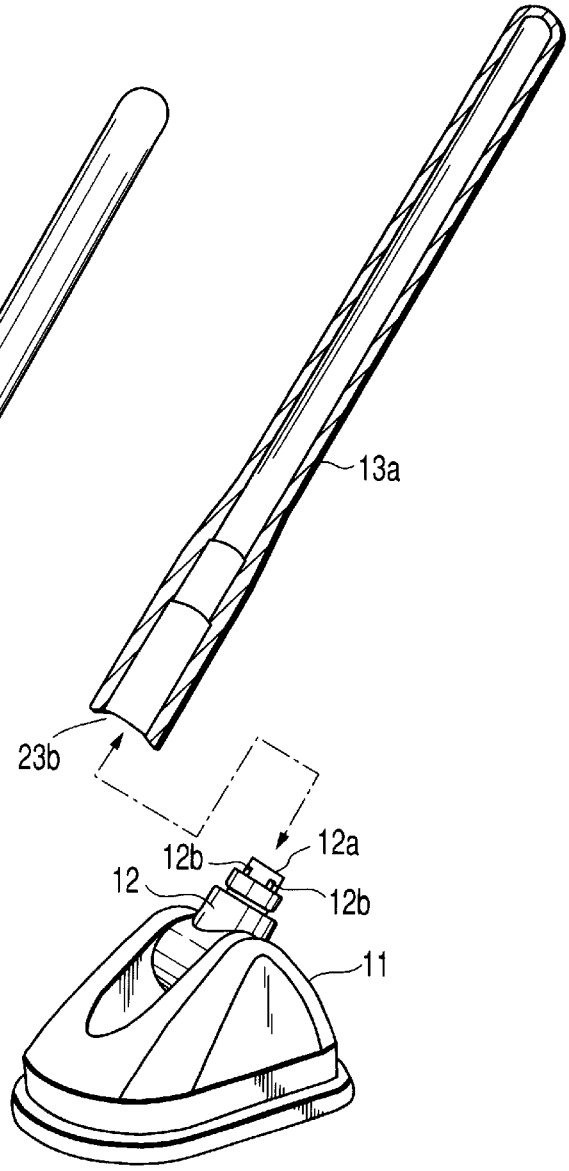
FIG. 1B PRIOR ART

Hereinafter, the on-vehicle rod antenna device according to the embodiment of the present invention will be explained referring to the drawings.

Figure 2C:
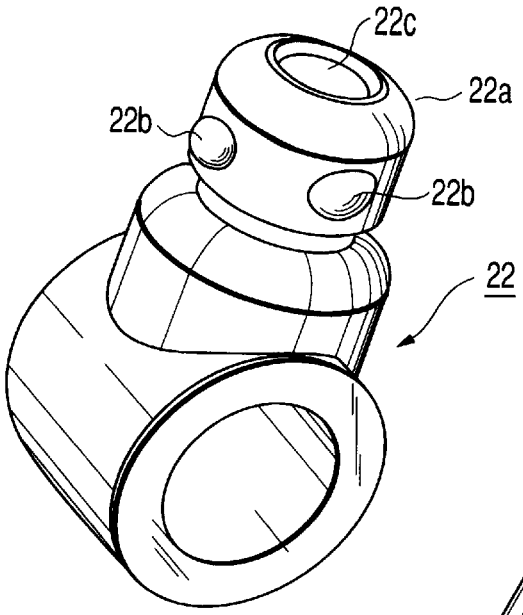
FIG. 2A to FIG. 2C are figures which show the external configuration etc. of the on-vehicle rod antenna device according to the embodiment of the present invention.
Figure 2A:
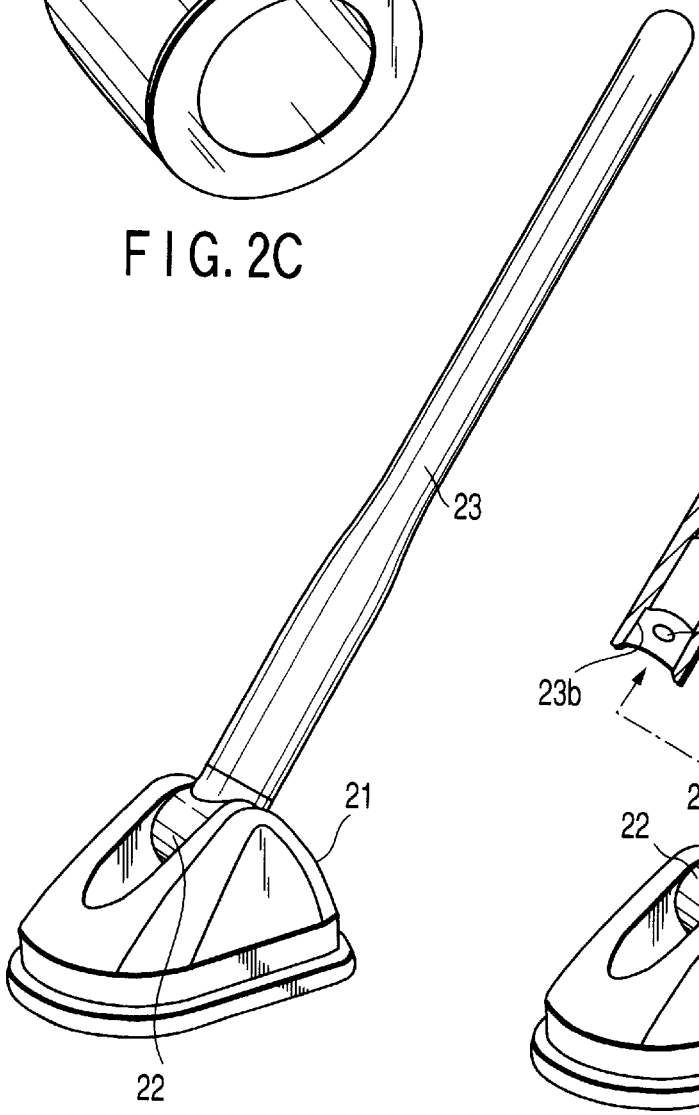
Figure 2B:
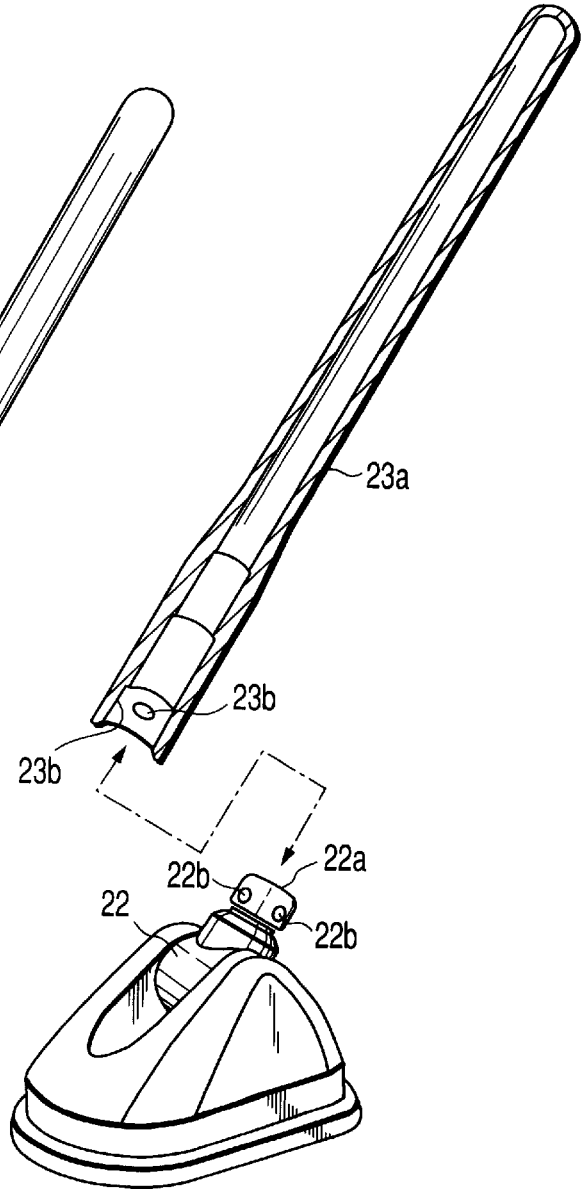

FIG. 2A shows an external configuration of the on-vehicle rod antenna device according to the embodiment of the present invention. In FIG. 2A, the on-vehicle rod antenna device 20 is constructed by screwing and attaching the antenna rod 23 to the joint assembly 22 rotatably provided to the antenna base 21 mounted on the vehicle FIG. 2B is a figure which shows an external configuration of the joint assembly 22, especially, in a state of detaching the antenna rod 23. The antenna rod cover 23*a* forms the outer surface of the above-mentioned the antenna rod 23, and is a cover made of, for example, the resin having elasticity such as rubber and the elastomer resin.

Tip portion 22*a* of the joint assembly 22 is covered with the antenna rod cover 23*a* by attaching the antenna rod 23. The plurality of (for example, four) substantially hemisphere salients 22*b* are radially formed about along the outer circumferential surface of the tip portion 22*a* of the joint assembly 22. FIG. 2C shows outline view of the joint assembly 22.

The salients 22*b* are made of, for example, the resin with the ABS resin etc. and are formed with the tip portion 22*a* as one body. The recesses 23*b* are formed to be engaged with the salients 22*b* at the inner circumferential surface of the antenna rod cover 23*a* corresponding to the salients 22*b* in a state that the above-mentioned antenna rod 23 is screwed and attached on the joint assembly 22.

That is, a side where the recesses 23*b* of the antenna rod cover 23*a* are formed is moved along axial direction by properly transforming by the elasticity of the salients 22*b* formed in the outer circumference of the tip portion 22*a* of the joint assembly 22, when screwing and attaching the antenna rod 23 to the joint assembly 22. The antenna rod 23 engages with the salients 22*b* formed on the outer circumferential surface of the tip portion 22*a* when the recesses 23*b* reaches a predetermined position of the joint assembly 22. As a result, the antenna rod 23 is set to the state that the transformation by elasticity is released.

When the antenna rod 23 is loosened to detach the antenna rod 23 from the joint assembly 22 in the state that the recesses 23*b* of the antenna rod cover 23*a* engages with the salients 22*b* of the tip portion 22*a,* it is necessary to transform the antenna rod cover 23*a* again by the elasticity by the salients 22*b* of the tip portion 22*a*. Therefore, the antenna rod 23 is not detached from the joint assembly 22 by loosening by the outside power such as the vibrations of the vehicle where the on-vehicle rod antenna device 20 according to this embodiment is attached, since resistance is generated for loosening the antenna rod 23.

Figure 3:
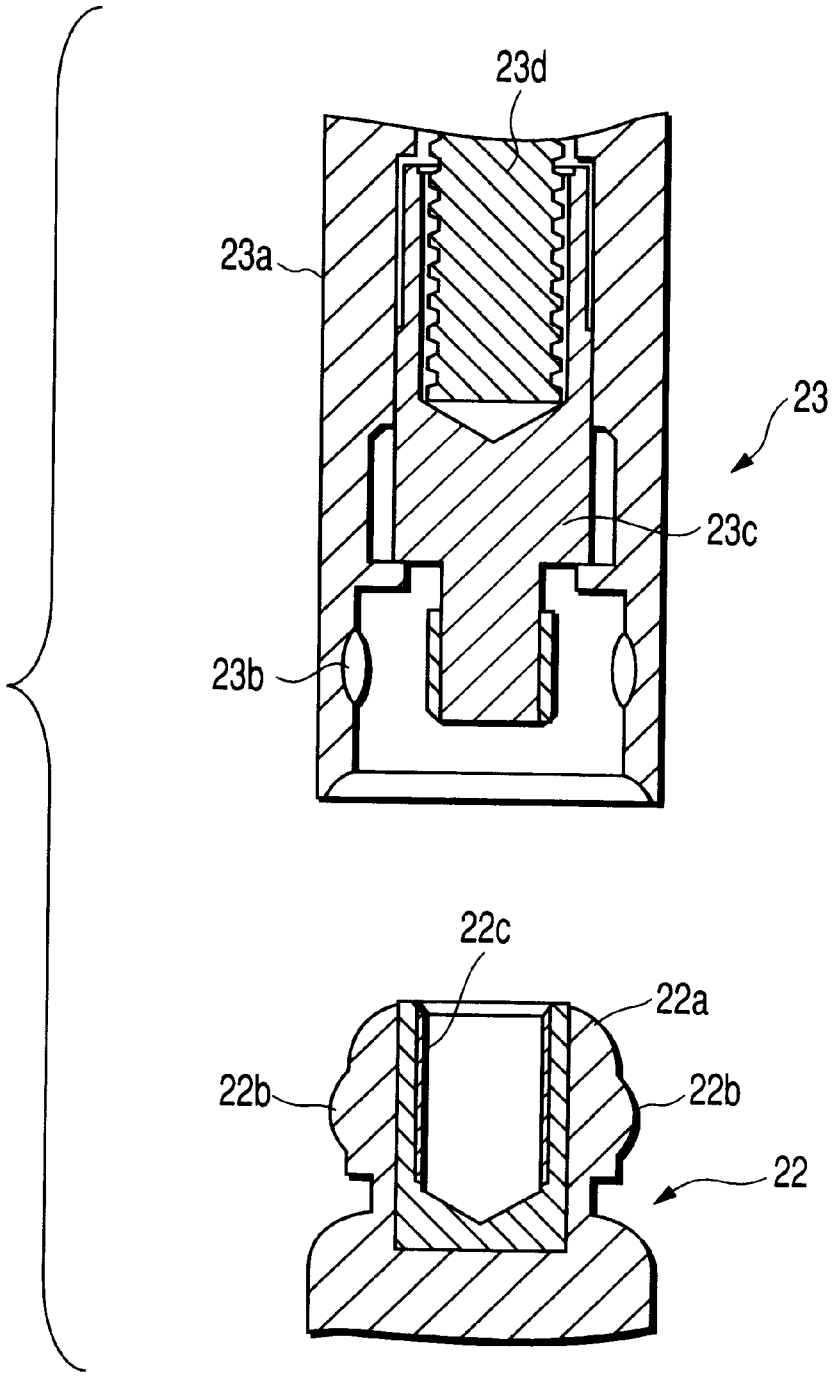
FIG. 3 is a sectional view which shows especially a connection structure of the joint assembly and the antenna rod in FIG. 2A to FIG. 2C.

FIG. 3 is a sectional view to explain the screw attachment structure of the above-mentioned joint assembly 22 and the antenna rod 23. The cylindrical joint section 22*c* which is screwed at inner surface thereof is laid underground at the center of the tip portion 22*a* made of the resin so as not to be exposed from the tip surface of the tip portion 22*a* for the upper portion of the joint assembly 22 as shown in FIG. 3. The locking salients 22*b* are formed on the outer circumferential surface on the tip portion 22*a* as one body.

On the other hand, the clamp 23*c* in which the screw section which screws the joint section 22*c* is formed to the point thereof is undergrounded in cylindrical bottom of the antenna rod cover 23*a*. The antenna rod element 23*d* is drawn out and is undergrounded in the axis section of the antenna rod cover 23*a* to connect with the clamp 23*c*.

Therefore, when the clamp 23*c* of the antenna rod 23 is screwed to the joint section 22*c* of the joint assembly 22 to attach the antenna rod 23 to the joint assembly 22, the point of the attached side of the antenna rod cover 23*a* of the antenna rod 23 is properly transformed by the elasticity by the salients 22*b* provided on the outer circumferential surface of the tip portion 22*a* of the joint assembly 22. The antenna rod cover 23*a* moves along the axial direction thereof while the resistance is generated.

The transformation by the above-mentioned elasticity is released if the recesses 23*b* is engaged with the salients 22*b* formed on the outer circumferential surface of the tip portion 22*a* of the joint assembly 22, when the recesses 23*b* formed in the antenna rod cover 23*a* reaches even a predetermined position to the joint assembly 22.

When the antenna rod 23 is loosened to detach the antenna rod 23 from the joint assembly 22 in the state that the recesses 23*b* of the antenna rod cover 23*a* engages with the salients 22*b* of the tip portion 22*a,* it is necessary to transform the antenna rod cover 23*a* again by the elasticity by the salients 22*b* of the tip portion 22*a*. Therefore, since resistance is generated for loosening the antenna rod 23.

Therefore, the antenna rod 23 is not detached from the joint assembly 22 by loosening by the outside power such as the vibrations of the vehicle where the on-vehicle rod antenna device 20 according to this embodiment is attached. Therefore, a sufficient locking effect can be achieved.

As described above, the locking effect can be achieved by engagement of the recesses 23*b* formed on the inner circumferential surface of the antenna rod cover 23*a* of the joint assembly 22 and the salients 22*b* provided on the outer circumferential surface if the tip portion 22*a* the antenna rod 23. In addition, since each shape thereof has a substantially comparatively large hemisphere, it becomes possible to maintain a sufficient locking effect for a long period without requiring a sever size accuracy.

The entire surface of the tip portion 22*a* of the joint assembly 22 can be shaped to have sufficient large roundness, especially as shown in FIG. 2C. The joint section 22*c* which is the clamp is constructed to prevent from projecting to the surface. Therefore, a sufficient safe structure can be obtained, since a pointed component is not exposed outside where the human body may be contacted, even in the state of detaching the antenna rod 23 from the joint assembly 22.

In the above-mentioned embodiment, the embodiment in which the substantially hemisphere salients 22*b* are provided on the joint assembly 22 and the recesses 23*b* are provided to the antenna rod 23 of the antenna rod 23 is explained, but the present invention is not limited to the embodiment. For example, the recesses may be provided on the joint assembly 22 and the salient may be provided on the antenna rod 23.

The on-vehicle rod antenna device according to the above-mentioned embodiment of the present invention is characterized by comprising: an antenna rod; and an antenna base comprising a joint section to which the antenna rod is connected, in which the joint section comprises a tip portion, the tip portion is covered with the antenna rod in a state of connecting the antenna rod, and a substantially hemisphere recess or salient engaging with an inner circumferential surface of the antenna rod is formed on an outer circumferential surface of the tip portion. As mentioned above, the locking effect can be achieved by the engagement of a comparatively large substantially hemisphere salients and recesses formed on the tip portion of the joint section and the inner circumferential surface of the antenna rod. Therefore, it becomes possible to maintain a sufficient locking effect for a long period without requiring a sever size accuracy. In addition, the entire surface of the tip portion of the joint section can be shaped to have sufficient large roundness. Therefore, a pointed component is not exposed outside, where the human body can be contacted, even in the state of detaching the antenna rod.

In this embodiment, preferable manners are as follows. Each undermentioned manner may be applied solely or with combining them.

(1) A screw section which screws and connects the antenna rod with the joint section is further provided.

(2) A tip surface of the tip portion has a curved surface.

In the state of detaching the antenna rod, the projection object mounted on the car does not give the person harm.

(3) At least a part of the tip portion and the antenna rod has an elasticity body. The locking effect can be easily achieved without requiring a complex structural body.

The present invention is not limiting to the above-mentioned embodiment, and can be modified in the scope of the invention.

What is claimed is:

1. An on-vehicle rod antenna device comprising:

an antenna rod; and an antenna base comprising a joint section to which said antenna rod is connected, wherein said joint section comprises a tip portion, said tip portion is covered with said antenna rod in a state of connecting said antenna rod, and a substantially hemisphere recess or salient engaging with an inner circumferential surface of said antenna rod is formed on an outer circumferential surface of said tip portion.

2. The on-vehicle rod antenna device according to claim 1, wherein at least a part of said tip portion and said antenna rod has an elasticity body.

3. The on-vehicle rod antenna device according to claim 1, wherein a tip surface of said tip portion has a curved surface.

4. The on-vehicle rod antenna device according to claim 3, wherein at least a part of said tip portion and said antenna rod has an elasticity body.

5. The on-vehicle rod antenna device according to claim 1, further comprising a screw section which screws and connects said antenna rod with said joint section.

6. The on-vehicle rod antenna device according to claim 5, wherein at least a part of said tip portion and said antenna rod has an elasticity body.

7. The on-vehicle rod antenna device according to claim 5, wherein a tip surface of said tip portion has a curved surface.

8. The on-vehicle rod antenna device according to claim 7, wherein at least a part of said tip portion and said antenna rod has an elasticity body.

* * * * *